United States Patent [19]

McElroy et al.

[11] 4,315,208

[45] Feb. 9, 1982

[54] REGULATED POWER SUPPLY HAVING ITS D.C. VOLTAGE SOURCE SELECTIVELY SUPPLEMENTED BY A D.C. TO D.C. CONVERTER

[75] Inventors: John M. McElroy, Monroeville; John O. G. Darrow, Murrysville, both of Pa.

[73] Assignee: American Standard Inc., Swissvale, Pa.

[21] Appl. No.: 167,857

[22] Filed: Jul. 14, 1980

[51] Int. Cl.[3] ..... G05F 5/00

[52] U.S. Cl. ..... 323/303; 307/64; 363/101

[58] Field of Search ..... 307/44, 46, 48, 49, 307/64, 66; 322/22 T; 363/16, 22, 24, 101; 323/299, 303

[56] References Cited

U.S. PATENT DOCUMENTS

| | | | |
|---|---|---|---|
| 2,886,763 | 5/1959 | Zelina . | |
| 3,106,645 | 10/1963 | Kaufman . | |
| 3,327,199 | 6/1967 | Gardner et al. . | |
| 3,527,997 | 9/1970 | Nercessian . | |
| 3,697,857 | 10/1972 | El-Banna | 363/101 |
| 3,743,887 | 7/1973 | Keough et al. . | |
| 4,209,710 | 6/1980 | Quarton | 323/22 T X |

*Primary Examiner*—William M. Shoop

*Attorney, Agent, or Firm*—J. B. Sotak

[57] ABSTRACT

A transistorized power supply for providing a constant voltage to a load. A series regulator interposed between a d.c. input voltage source and the load to regulate the d.c. output voltage. A d.c. to d.c. converter serially connected between the d.c. input voltage source and the series regulator. The d.c. to d.c. converter is selectively actuated to supplement the d.c. input voltage when the d.c. input voltage falls below a predetermined value in order to maintain a constant voltage across the load.

11 Claims, 1 Drawing Figure

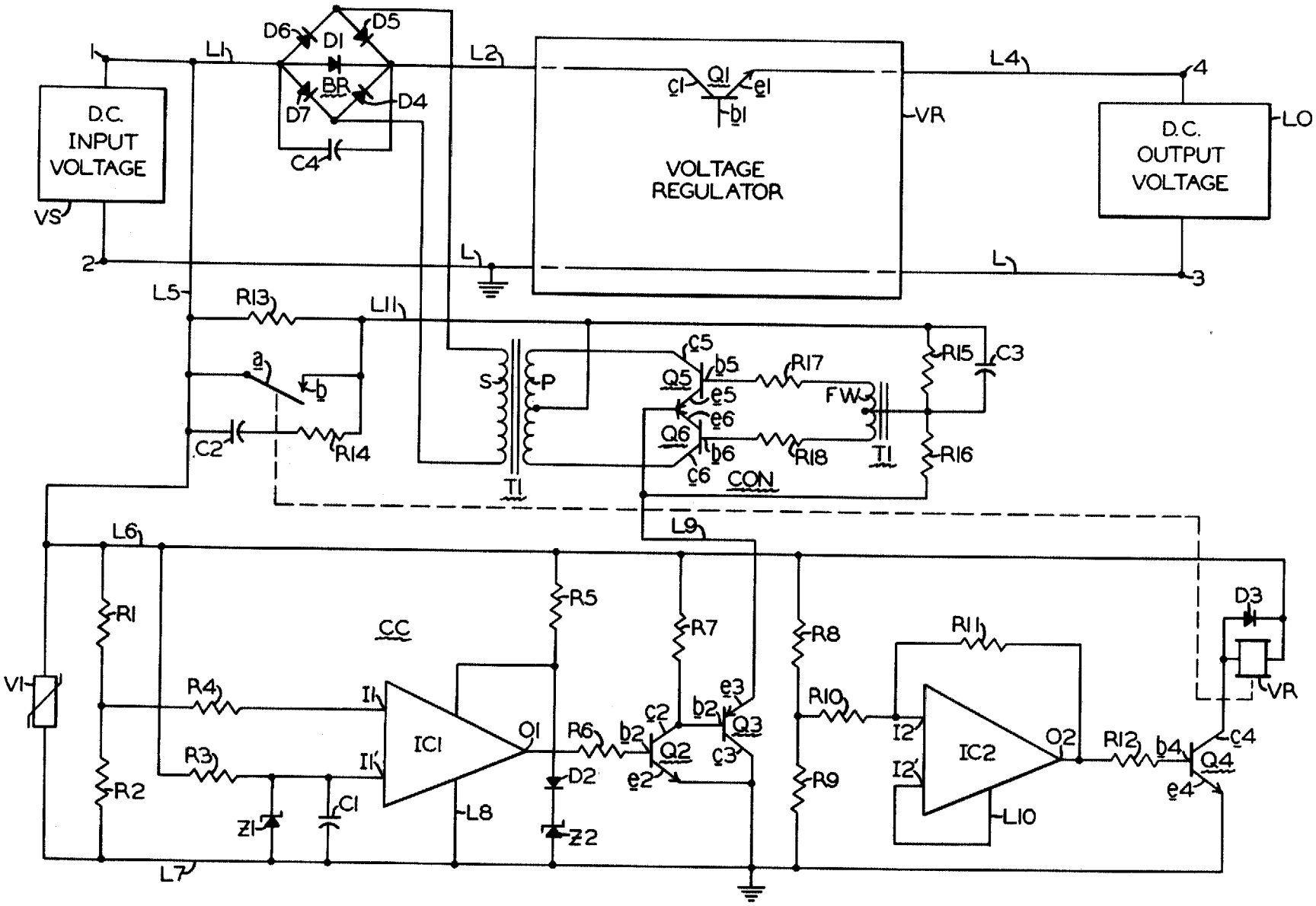
D.C. OUTPUT VOLTAGE
VOLTAGE REGULATOR
D.C. INPUT VOLTAGE
CON
CC
IC1
IC2
VR
VS
VI

REGULATED POWER SUPPLY HAVING ITS D.C. VOLTAGE SOURCE SELECTIVELY SUPPLEMENTED BY A D.C. TO D.C. CONVERTER

FIELD OF THE INVENTION

This invention relates to an electronic d.c. regulated power supply, and, more particularly, to a voltage regulator and a complementary d.c. to d.c. converter which is selectively activated to provide supplemental d.c. voltage to complement a source of d.c. input voltage whereby the voltage regulator is capable of maintaining a given d.c. output voltage when the source d.c. input voltage drops below a certain value.

BACKGROUND OF THE INVENTION

In a cab signal speed command system of a transit operation, it is an authoritative requirement that the overspeed equipment must be capable of functioning over a wide range of supply voltages. Theoretically, the main car battery may vary between 22 to 44 volts d.c. In practice, the car-carried apparatus operates on 28 volts d.c., and the nominal battery voltage is 37 volts d.c. It has been found that the battery voltage seldom drops below 37 volts so that a simple series regulator may generally be used to provide the necessary 28 volts d.c. most of the time. However, even though the battery supply voltage falls below 37 volts only two percent (2%) of the time, it is necessary to employ a suitable device for maintaining the 28 volts at all times. In the past, a continuous operating d.c. to d.c. converter power supply was relied on to produce the required operating potential. However, most conventional converter circuits are costly to maintain or unreliable in continuous operation. Accordingly, there is a need for providing a power supply which is reliable in operation and inexpensive to maintain.

OBJECTS OF THE INVENTION

Accordingly, it is an object of this invention to provide an improved power supply which provides a constant regulated output voltage even during an input voltage drop.

A further object of this invention is to provide a unique regulated power supply having its input voltage selectively supplemented by a d.c. to d.c. converter.

Another object of this invention is to provide a novel voltage regulator which is reinforced by a converter during a low voltage condition.

Still a further object of this invention is to provide an electronic regulated voltage supply which is selectively complemented by a d.c. to d.c. converter circuit.

Still another object of this invention is to provide a power supply including a voltage regulator and a d.c. to d.c. converter which is activated to supply additional d.c. voltage to the voltage regulator when its battery voltage drops below a given level.

Yet a further object of this invention is to provide a regulated power supply comprising, a regulator connectable between a d.c. voltage source and a load for regulating the d.c. voltage source so that a constant d.c. voltage is developed across the load, and a controlled d.c. to d.c. converter connectable between the d.c. voltage source and the regulator for selectively adding supplemental d.c. voltage when the magnitude of the d.c. voltage source falls below a predetermined value.

Yet another object of this invention is to provide a new and improved regulated power supply which is economical in cost, simple in design, reliable in operation, durable in use, dependable in service, and efficient in operation.

SUMMARY OF THE INVENTION

In accordance with the present invention, there is provided a solid-state power supply including a series regulator interconnected between a source of d.c. input voltage and an output load. The impedance of the series regulator is varied to control the current and, in turn, the voltage developed across the load. Thus, a constant output voltage is supplied to the load by the regulator. An ancilliary converter supplements the d.c. input voltage source to maintain a constant output voltage across the lead when the d.c. input voltage falls below a predetermined value. A control circuit including a comparator monitors the level of the d.c. input voltage and switches on the converter when the d.c. input voltage reaches the predetermined value. The converter includes a push-pull transistor oscillator which supplies a.c. voltage to a bridge rectifier. The bridge rectifier rectifies the d.c. voltage and serially adds the rectified voltage to the d.c. input voltage to increase the voltage level. A switchable device is adapted to increase the operating voltage supplied to the converter for increasing the supplemental rectified voltage added to the d.c. input voltage.

BRIEF DESCRIPTION OF THE DRAWING

The foregoing objects and other attendant features and advantages of this invention will become more fully understood from the foregoing detailed description when considered in conjunction with the accompanying drawing wherein:

The single FIGURE is a schematic circuit diagram illustrating the preferred embodiment of the solid-state regulated power supply having a supplemental inverter of the present invention.

DETAILED DESCRIPTION OF THE INVENTION

Referring now to the single FIGURE of the drawing, there is shown the electronic voltage regulator and d.c. to d.c. converter portions of the power supply of the present invention. As shown, a pair of input terminals 1 and 2 is connected to an unregulated d.c. input voltage source VS, such as, a main battery, which is carried on board a mass transit vehicle. In practice, the nominal value of the battery voltage is 37 volts d.c.; however, it is an authoritative requirement that the power supply must operate over a voltage range from 22 to 44 volts to produce a regulated output voltage of 28 volts d.c. The input terminal 1 is supplied with a positive potential from a suitable source VS of d.c. input voltage while the input terminal 2 is connected to the negative terminal of voltage source VS which constitutes one end of a common lead or ground bus L for the supply circuit. The other end of bus L is connected to output terminal 3 which along with positive output terminal 4 are connected to a load LO, such as, the cab signal equipment carried onboard a transit vehicle. The positive input voltage terminal 1 and lead L1 are connected to lead L2 via diode D1. In practice, a conventional series voltage regulator VR is interposed between the source of d.c. input voltage VS and the load LO which is connected across output terminals 4 and 3. The d.c. output voltage developed across load LO, namely, between terminals 4 and 3, is regulated by controlling the series resistance or impedance of the regulating transistor c1 which has a base electrode b1, a collector electrode C1, and an emitter electrode e1. As shown, lead L2 is connected to the collector electrode c1 while the emitter electrode e1 is connected by lead L4 to positive output terminal 4. It will be appreciated that the condition of series regulating transistor Q1 is controlled by varying the base current of electrode b1. It is conventional to sense the voltage across terminals 4 and 3 and/or to monitor the current flowing to the load L0. Thus, the state of conduction of the series pass transistor Q1 is controlled by a control circuit which is responsive to the variations of the voltage and/or current supplied to the load L0 which is connected across output terminals 3 and 4.

As will be described hereinafter, the d.c. input voltage source appearing across terminals 1 and 2 is periodically or selectively supplemented by d.c. voltage produced by the converter portion of the power supply. As shown, the positive voltage terminal 1 is connected by lead L5 to a control circuit CC and converter circuit CON. The control circuit CC includes a transient noise suppression varistor V1 connected between positive lead L6 and common or ground lead L7. A voltage dividing network including resistors R1 and R2 is connected between leads L6 and L7. A voltage reference network comprising resistor R3 and zener diode Z1 is also connected between leads L6 and L7. A by-pass capacitor C1 is connected across zener diode Z1. The junction point between voltage dividing resistors R1 and R2 is connected by resistor R4 to one input I1 of a voltage level detector IC1 in the form of an integrated circuit operational amplifier circuit comparator. The integrated circuit IC1 is one-fourth of a guad-amp designated MC3403L made and sold by Motorola, Inc. The other input I1' of comparator IC1 is connected to the junction point of resistor R3 and zener diode Z1 which provide a constant reference voltage. The negative supply voltage terminal of the comparator IC1 is directly connected to ground lead L7 via lead L8. The positive supply voltage terminal of comparator IC1 is connected to a junction point of a voltage dividing network comprising resistor R5 and diode D2 and zener dioe Z2. Thus, a constant operating potential is supplied to the comparator IC1 by the zener diode Z2. The ouptut terminal 01 of the integrated circuit comparator IC1 is connected to the input of a driver stage including an NPN transistor Q2. The driver transistor Q2 includes a base electrode b2, a collector electrode c2, and an emitter electrode e2. As shown, the base electrode b2 is connected to the output terminal 01 of comparator IC1 via resistor R6. The collector electrode c2 is connected to positive lead L6 via resistor R7 and is also connected to the input of a switching transistor Q3. The PNP transistor Q3 includes a base electrode b3, a collector electrode c3, and an emitter electrode e3. It will be seen that the collector electrode c2 of driver transistor Q2 is directly connected to the base electrode b3 of switching transistor Q3. The emitter electrode e2 of transistor Q2 and the collector electrode c3 of transistor Q3 are connected in common and, in turn, are directly connected to ground lead L7. The emitter electrode e3 of switching transistor Q3 is connected by lead L9 to the converter circuit CON which will be described in greater detail hereinafter.

A voltage dividing network including resistors R8 and R9 is connected between positive lead L6 and ground lead L7. The junction point of resistors R8 and R9 is connected by resistor R10 to an input terminal I2 of an integrated circuit operational amplifier comparator IC2 which may be the second fourth of the MC3403L quad-amp. A positive or regenerative feedback circuit is connected from the output terminal 02 to the input terminal I2 via feedback resistor R11. It will be seen that the reference voltage is applied to an input terminal I2' via lead L10 which is effectively connected to the junction point of the voltage reference network comprising resistor R3 and zener diode Z1. Further, it will be noted that the output terminal 02 of the comparator IC2 is coupled to the input of an NPN transistor Q3 which includes a base electrode b3, a collector electrode c3, and an emitter electrode e3. That is, the output terminal 02 of comparator IC2 is connected to the base electrode b3 via resistor R12. The emitter electrode e3 is directly connected to ground lead L7 while the collector electrode c3 is connected to one end of the coil of an electromagnetic relay VR. The other end of the relay coil is directly connected to positive lead L6, and a surge suppressing diode D3 is connected across the coil of relay VR. It will be seen that the relay VR is mechanically linked to a movable heel contact a. The heel contact a is arranged to make and break contact with an associated front contact b.

The heel contact a is connected to lead L5 while the front contact point b is connected to the positive supply lead L11 of converter CON. A current limiting resistor R13 is also connected between leads L5 and L11. A series connected resistor R14 and capacitor C2 are connected across contacts a–b to subdue and suppress arcing when the relay VR is deenergized and released. A voltage dividing network including resistors R15 and R16 is connected between positive supply lead L11 and lead L9 which is connected to emitter electrode e3 of switching transistor Q3. A by-pass filter compacitor C3 is connected in parallel with resistor R15. The junction point of voltage dividing resistors R15 and R16 is connected to the center-tap of a tertiary or feedback winding FW of a transformer T1. The upper end of feedback winding FW is connected to the input of one of a pair of push-pull NPN transistors Q5–Q6 of the d.c. to d.c. converter while the lower end of the feedback winding FW is connected to the input of the other of the pair of oscillating transistors. The oscillating transistor Q5 includes a base electrode b5, a collector electrode c5, and an emitter electrode e5 while the oscillating transistor Q6 includes a base electrode b6, a collector electrode c6, and an emitter electrode e6. As shown, the top end of winding FW is connected to the base electrode b5 via resistor R17 while the bottom end of winding FW is connected to base electrode b6 via resistor R18. It will be seen that the emitter electrodes e-5–e-6 are connected in common and are coupled to lead L9 and, in turn, to the emitter electrode e3 of switching transistor Q3. The collector electrode c5 is connected to the top end of a center-tapped primary winding P of the transformer T1 while the collector electrode c6 is connected to the bottom end of primary winding P. The center tap of primary winding P is directly connected to positive voltage lead L11. The transformer T1 includes a secondary winding S which supplies a.c. signals to a full-wave bridge rectifier BR. The bridge rectifier BR includes a plurality of diodes D4, D5, D6, and D7 for providing rectified voltage which supplements the d.c. input voltage source VS. The opposite ends of the secondary winding S are connected to the a.c. terminals of the bridge rectifier BR while the d.c. terminals are connected across diode D1. A noise filtering capacitor C4 is connected across the rectifier to remove ripple and suppress interference signals from the rectified d.c. voltage.

Turning now to the operation of the power supply of the present invention, it will be initially assumed that components are intact and that the circuit is operating properly and that the nominal voltage on d.c. input terminals 1 and 2 is at least 37 volts. Under such a condition, the conduction of the voltage regulating transistor Q1 is controlled to reduce the d.c. input voltage to cause a ±28volts d.c. to appear across output terminals 4 and 3. The level of output voltage is continually monitored and any change is sensed to vary the impedance exhibited by the series regulating transistor Q1 in a conventional manner. Further, it will be appreciated that the converter CON is inactive or in a quiescient condition since the d.c. input voltage is sufficient to supply the demands of the load LO.

Let us now assume that the d.c. input voltage across terminals 1 and 2 drops below 30 volts and that it is still necessary to maintain 28 volts across terminals 4 and 3. However, the power losses or voltage drops within the regulator make it impossible to maintain 28 volts across output terminals 4 and 3 when the d.c. input voltage falls below 30 volts. Thus, it is necessary to supplement the d.c. input voltage appearing across terminals 1 and 2 by serially adding complementary d.c. voltage to the input of the voltage regulator VR. It will be seen that the d.c. input voltage is monitored by the control circuit CC so that the integrated circuit comparator IC1 is toggled on when the d.c. input voltage falls below 30 volts. This is, the drop in voltage on lead L5 and in turn, in lead L6 causes a decrease in voltage at the junction point between resistors R1 and R2 so that the comparator IC1 produces a positive output voltage. The positive voltage turns on driver transistor Q2 which switches on transistor Q3. The conduction of transistor Q3 establishes a circuit path to ground for the converter CON via lead L9. The oscillating transistors Q5 and Q6 operate in a push-pull fashion with the winding FW providing positive feedback voltage for causing a.c. voltage signals to be induced in secondary winding S. The a.c. voltage signals are rectified by the bridge rectifier BR to cause supplemental d.c. voltage to be serially added to the d.c. input voltage on terminals 1 and 2. It will be seen that the d.c. supply voltage to the converter CON is conveyed to lead L11 via resistor R13. The resistor R13 limits the current supplied to converter CON so that its output is not excessive and does not result in power dissipating problems in the series regulator VR. This limiting action continues so long as the battery voltage remains above 25 volts. Now, when the battery voltage falls below 25 volts, it is necessary to increase the output of the converter CON so that 28 d.c. volts will continue to be produced across output terminals 4 and 3. Thus, when the input voltage drops below 25 volts, the comparator IC2 is toggled on which causes the conduction of transistor Q4. This causes the energization of relay VR which picks up heel contact a and closes front contact b. Thus, the current limiting resistor R13 is shunted by contacts a–b which results in maximum supply voltage to appear on lead L11. Ergo, the converter CON increases its output so that 28 volts continue to be produced across output terminals 4 and 3.

Now, when the main battery is replaced or recharged to its nominal 37 volts, the converter CON reverts to its inactive nonoperating condition due to the opening of the ground circuit path by the nonconduction of switching transistor Q3. The switch contacts a–b become opened due to the deenergization of relay VR and the nonconduction of transistor Q4. Thus, it has been found that the converter is relatively efficient since it remains deactivated approximately ninety-eight percent (98%) of the time and is only activated when the battery falls below 30 volts which is only two percent (2%) of the time.

It will be appreciated that various changes, modifications, and alterations may be made by persons skilled in the art without departing from the spirit and scope of the present invention. For example, the various voltage levels may be changed depending upon battery voltage and the desired output voltage or load demands. It will be appreciated that the input voltage has been described as a main battery of a transit vehicle; however, it is understood that a d.c. generator or other power source may be connected to terminals 1 and 2. It is also obvious that the NPN transistors could be replaced by PNP transistors, and the PNP transistor could be replaced by an NPN transistor as long as the polarities of the appropriate voltages and diodes are reversed. In addition it will be apparent that various other changes and modifications may be made to the subject invention and, therefore, it is understood that all modifications, variations, and equivalents within the spirit and scope of the present invention are herein meant to be encompassed in the appended claims.

Having thus described the invention, what we claim as new and desire to secure by Letters Patent, is:

1. A regulated power supply comprising, a regulator connectable between a d.c. voltage source and a load for regulating the d.c. voltage source so that a constant d.c. voltage is developed across the load, and a controllable d.c. to d.c. converter connectable between the d.c. voltage source and said regulator for selectively adding supplementary d.c. voltage when the magnitude of the d.c. voltage source falls below a predetermined value.

2. The regulated power supply as defined in claim 1, wherein said regulator takes the form of a series regulating semiconductor device.

3. The regulated power supply as defined in claim 1, wherein said controllable d.c. to d.c. converter is normally quiescent when the magnitude of the d.c. voltage source is above the predetermined value.

4. The regulated power supply as defined in claim 1, wherein a level detector monitors the d.c. voltage source and turns on a switch when the magnitude of the d.c. voltage source falls below the predetermined value.

5. The regulated power supply as defined in claim 4, wherein said controllable d.c. to d.c. converter is activated when said switch is turned on.

6. The regulated power supply as defined in claim 1, wherein said controllable d.c. to d.c. converter includes a full-wave rectifying network connected in series with the d.c. voltage source.

7. The regulated power supply as defined in claim 1, wherein a switchable device increases the operating voltage supplied to said controllable d.c. to d.c. converter for increasing the supplemental d.c. voltage.

8. The regulated power supply as defined in claim 4, wherein said level detector includes an integrated circuit comparator.

9. The regulated power supply as defined in claim 1, wherein said controllable d.c. to d. c. converter includes a push-pull transistor oscillator.

10. The regulated power supply as defined in claim 7, wherein said switchable device is a relay contact which shunts a resistor to increase the operating voltage.

11. The regulated power supply as defined in claim 10, wherein an integrated circuit comparator and switching transistor energizes a coil of a relay to control said contact.

* * * * *